US008633878B2

(12) United States Patent
Akimoto et al.

(10) Patent No.: US 8,633,878 B2
(45) **Date of Patent: *Jan. 21, 2014**

(54) IMAGE DISPLAY

(75) Inventors: Hajime Akimoto, Ome (JP); Shigeyuki Nishitani, Mobara (JP); Shinichi Komura, Hitachi (JP); Toshihiro Sato, Mobara (JP); Hiroshi Kageyama, Kokubunji (JP); Yoshiteru Shimizu, Kokubunji (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,771

(22) Filed: Mar. 6, 2012

(65) Prior Publication Data

US 2012/0162180 A1 Jun. 28, 2012

Related U.S. Application Data

(63) Continuation of application No. 13/195,588, filed on Aug. 1, 2011, now Pat. No. 8,159,427, which is a continuation of application No. 11/859,414, filed on Sep. 21, 2007, now Pat. No. 8,031,144, which is a continuation of application No. 10/965,864, filed on Oct. 18, 2004, now Pat. No. 7,277,072, which is a continuation of application No. 10/075,591, filed on Feb. 15, 2002, now Pat. No. 6,876,345.

(30) Foreign Application Priority Data

Jun. 21, 2001 (JP) ..... 2001-187478

(51) Int. Cl.
*G09G 3/32* (2006.01)

(52) U.S. Cl.
USPC ..... 345/82

(58) Field of Classification Search
USPC ..... 345/82, 83, 44, 46
See application file for complete search history.

(56) References Cited

U.S. PATENT DOCUMENTS 4,996,523 A 2/1991 Bell et al.
5,170,155 A 12/1992 Plus et al.

(Continued)

FOREIGN PATENT DOCUMENTS

JP 8-241048 9/1996
JP 2000-235370 8/2000

OTHER PUBLICATIONS

"Design of an Improved Pixel for a Polysilicon Active-Matrix Organic LED Display," SID 98 Digest, Digest of Technical Papers, pp. 11-14.

*Primary Examiner* — William Boddie
*Assistant Examiner* — Jeffrey A Parker
(74) *Attorney, Agent, or Firm* — Antonelli, Terry, Stout & Kraus, LLP.

(57) ABSTRACT

An image display is provided with a display area including pixels, each including illuminating means. A control circuit turns the illuminating means of the pixels on and off. A first terminal of a capacitor is connected to an input terminal of the control circuit. An image signal voltage generation circuit generates image signal voltages and a pixel drive voltage generation circuit generates pixel drive voltages for the pixels. A connector is provided for connecting either one of the image signal voltages or the pixel drive voltages to a second terminal of the capacitor. As such, an amount of drive current for the pixels is controlled in accordance with both the pixel drive voltage and the image signal voltage.

16 Claims, 10 Drawing Sheets

(56) References Cited

U.S. PATENT DOCUMENTS

| | | | | |
|---|---|---|---|---|
| 5,451,978 | A | 9/1995 | Harju | |
| 5,952,789 | A * | 9/1999 | Stewart et al. | 315/169.4 |
| 5,990,629 | A | 11/1999 | Yamada et al. | |
| 6,157,356 | A | 12/2000 | Troutman | |
| 6,188,375 | B1 | 2/2001 | Kagey | |
| 6,229,506 | B1 | 5/2001 | Dawson et al. | |
| 6,229,508 | B1 | 5/2001 | Kane | |
| 6,329,974 | B1 | 12/2001 | Walker et al. | |
| 6,384,804 | B1 | 5/2002 | Dodabalapur et al. | |
| 6,486,606 | B1 | 11/2002 | Ting | |
| 6,611,108 | B2 * | 8/2003 | Kimura | 315/169.3 |
| 6,747,638 | B2 | 6/2004 | Yamazaki et al. | |
| 6,791,129 | B2 * | 9/2004 | Inukai | 257/208 |
| 6,795,064 | B2 | 9/2004 | Walker et al. | |
| 6,876,345 | B2 | 4/2005 | Akimoto et al. | |
| 6,919,868 | B2 | 7/2005 | Tam | |
| 2001/0045929 | A1 * | 11/2001 | Prache et al. | 345/89 |
| 2002/0000576 | A1 * | 1/2002 | Inukai | 257/202 |

* cited by examiner

IMAGE DISPLAY

CROSS-REFERENCE TO RELATED APPLICATIONS

This application is a continuation of application Ser. No. 13/195,588, filed Aug. 1, 2011, now U.S. Pat. No. 8,159,427 which, in turn, is a continuation of application Ser. No. 11/859,414, filed Sep. 21, 2007, now U.S. Pat. No. 8,031,144 which, in turn, is a continuation of application Ser. No. 10/965,864, filed Oct. 18, 2004 (now U.S. Pat. No. 7,277, 072), which, in turn, is a continuation of application Ser. No. 10/075,591, filed Feb. 15, 2002 (now U.S. Pat. No. 6,876, 345), and which is related to application Ser. No. 11/095,615 (now U.S. Pat. No. 7,142,180), the entire disclosures of which are hereby incorporated by reference.

BACKGROUND OF THE INVENTION

The present invention relates to an image display capable of multilevel illumination and more specifically to an image display with a sufficiently small display characteristic variation among pixels.

Referring to FIGS. 16, 17 and 18, two conventional technologies will be described.

FIG. 16 shows a configuration of a light emitting display device. Pixels 205 each having an organic electroluminescent device 204 as a pixel light emitting device are arranged in matrix in a display area and are connected to external drive circuits via gate lines 206, source lines 207 and power supply lines 208. In each pixel 205, the source line 207 is connected to a gate of a power TFT 203 and one end of a storage capacitor 202 through a logic TFT (thin-film transistor) 201, with one end of the power TFT 203 and the other end of the storage capacitor 202 connected in common to the power supply line 208. The other end of the power TFT 203 is connected to a common power supply terminal through the organic electroluminescent device 204.

An operation of this first example of the conventional technology will be described. When the gate line 206 opens or closes the logic TFTs 201 on a predetermined pixel line, a signal voltage that has been supplied from the external drive circuit to the source line 207 is input to the gate of the power TFT 203 and to the storage capacitor 202 where it is held. The power TFT 203 supplies a drive current according to the signal voltage to the organic electroluminescent device 204, causing it to illuminate in response to the signal voltage.

Such a conventional technology is detailed in, for example, JP-A-8-241048 (laid open on Sep. 17, 1996).

While in this conventional example the term "organic electroluminescent device" is used in conformity with the known example cited above, the device is often referred to as an organic light emitting diode (OLED) in recent years. In this specification, the latter designation will be used.

Next, by referring to FIG. 17 and FIG. 18, another conventional technology will be described.

FIG. 17 shows a configuration of a light emitting display device using the second conventional technology. Pixels 215 each having an organic light emitting diode (OLED) 214 as a pixel light emitting device are arranged in matrix. In FIG. 17 only one pixel is shown for the sake of simplicity. The pixels 215 are connected to external drive circuits through select lines 216, data lines 217 and power supply lines 218. In each pixel 215, the data line 217 is connected through an input TFT 211 to one end of a cancel capacitor 210, the other end of which is connected to a gate of a drive TFT 213, one end of a storage capacitor 212 and one end of an auto-zero switch 221.

The other end of the storage capacitor 212 and one end of the drive TFT 213 are connected in common to the power supply line 218. The other ends of the drive TFT 213 and the auto-zero switch 221 are connected in common to one end of the an EL switch 223, the other end of which is connected through an OLED 214 to a common power supply terminal. The auto-zero switch 221 and the EL switch 223 are constructed of TFTs and their gates are connected to an auto-zero input line (AZ) 222 and an EL input line (AZB) 224, respectively.

Now, the operation of the second conventional technology will be explained by referring to FIG. 18. FIG. 18 shows drive waveforms of the data line 217, auto-zero input line (AZ) 222, EL input line (AZB) 224, and select line 216 when a display signal is supplied to the pixels. The pixels are constructed of a p-channel TFT and thus the drive waveforms of FIG. 18 represent an off-state of the TFTs when they are at high level (on high voltage side) and an on-state when they are at low level (on low voltage side).

At timing (1) in the figure, the select line 216 is on, the auto-zero input line (AZ) 222 is on and the EL input line (AZB) 224 is off. In response to this, the input TFT 211 turns on, the auto-zero switch 221 turns on and EL switch 223 turns off. This causes an off-level signal voltage, which has been input to the data line 217, to be fed to one end of the cancel capacitor 210. At the same time, the turn-on of the auto-zero switch 221 resets a gate-source voltage of the diode-connected drive TFT 213 to (voltage of power supply line 218+ Vth), where Vth is a threshold voltage of the drive TFT 213. This operation, when an off-level signal voltage is input to the pixel, causes the gate of the drive TFT 213 to be auto-zero-biased to the threshold voltage.

Next, at timing (2) in the figure, the auto-zero input line (AZ) 222 is off and the data line 217 receives a signal of a predetermined level. As a result, the auto-zero switch 221 turns off and an on-level signal is fed to one end of the cancel capacitor 210. This operation causes the gate voltage of the drive TFT 213 to change by an added signal input level from the level that existed under the auto-zero bias condition.

Next, at timing (3) in the figure, the select line is off and the EL input line (AZB) 224 is on. As a result, the input TFT 211 turns off to store in the cancel capacitor 210 the signal input level that was applied to the cancel capacitor 210 through the turned-on input TFT 211. At the same time, the EL switch 223 is turned on. This operation fixes the gate of the drive TFT 213 at a voltage to which the gate voltage has been increased from the threshold voltage by the added signal input level. The signal current driven by the drive TFT 213 illuminates the OLED 214 at a predetermined brightness.

These conventional technologies are detailed, for example, in DIGEST of Technical Papers, SID98, pp. 11-14.

SUMMARY OF THE INVENTION

With the conventional technologies described above, it is difficult to provide an image display which is capable of multi-level illumination and has a minimal pixel-to-pixel display characteristic variation. This is explained in the following.

In the first conventional technology described with reference to FIG. 16, the multi-level illumination is difficult to achieve. The organic electroluminescent device 204 is a current-driven device and the power TFT 203 to drive the organic electroluminescent device 204 functions as a voltage-input, current-output device. If there is a variation in the threshold voltage Vth of the power TFT 203, components of the variation may be added to an entered signal voltage, causing a fixed luminance non-uniformity for each pixel. In general, the TFTs have greater pixel-to-pixel luminance variations than the single crystal silicon devices. Particularly when a large number of TFTs are built into, for example, a display area consisting of pixels, it is very difficult to minimize characteristic variations among devices. In the case of low-temperature polysilicon TFTs, for example, there are known to be threshold voltage variations on the order of 1 V. The OLEDs generally have illumination characteristics sensitive to an input voltage, and an input voltage change of 1 V may result in a two-fold luminance variation. In a half-tone image, the luminance non-uniformity of such a magnitude cannot be tolerated. To avoid this luminance variation, the signal voltage to be entered needs to be limited to two values, on and off, which in turn makes the multi-level illumination including half-tone illumination difficult.

As to the second conventional technology described with reference to FIG. 17 and FIG. 18, the cancel capacitor 210 and the auto-zero switch 221 are introduced to solve the problem described above. That is, this conventional example aims to avoid luminance non-uniformity in the OLED 214 by absorbing the variation in the threshold voltage of the drive TFT 213 by the terminal voltage of the cancel capacitor 210. In this conventional example, too, the multi-level illumination accuracy of the OLED 214 is degraded by other characteristic variations of the drive TFT 213 than the threshold voltage. In this conventional example, the drive current of the OLED 214 is obtained from a current output of the drive TFT 213. This means that, even if the threshold variation of the drive TFT 213 can be canceled, a possible variation in the current drive capability of the drive TFT 213 caused by a carrier mobility variation can result in a similar luminance non-uniformity among pixels like a gain variation. TFTs generally have large variations as described above and, particularly when a large number of TFTs are built into, for example, a display area consisting of pixels, it is very difficult to minimize characteristic variations among devices. In the case of low-temperature polysilicon TFTs, for example, there are known to be carrier mobility variations on the order of several tens of %. Therefore, even with this conventional technology, it is difficult to sufficiently minimize the illumination characteristic variation among pixels due to such a luminance non-uniformity.

As a method for eliminating the above-described display characteristic variation among pixels, JP-A-2000-235370 (laid open on Aug. 29, 2000) discloses a method which integrates into each pixel a "PWM (pulse width modulation) signal conversion circuit" for "converting input signal amplitude into a pulse width modulation." This method is based on an idea that because the driving of the OLED is controlled by only ON and OFF levels, the displayed image is not affected by the characteristic variation of the low-temperature polysilicon TFTs. This known example, however, has the following problems. First, it is desired that the "PWM signal conversion circuit" be constructed of the low-temperature polysilicon TFTs for the purpose of reducing the cost. In that case, the characteristic variation of the low-temperature polysilicon TFTs in turn results in a variation in the pulse width modulation, which is an output of the "PWM signal conversion circuit." A second problem is that, in the conventionally known "PWM display method," an image degradation is caused by "pseudo-profiling noise." This is a phenomenon observed in a plasma display in which if the display period shifts to one side of a frame in terms of time, profiling noise appears in a video image. In the plasma display, this problem is dealt with by signal processing of the modulated pulse width. It is, however, not realistic to realize such a sophisticated signal processing function with the "PWM signal conversion circuit" built into each pixel.

The problem described above can be solved by an image display which has at least a display area made up of a plurality of pixels and a signal line for feeding a display signal voltage to the pixels, the image display comprising: a first switch means for inputting the display signal voltage from the signal line to one end of a first capacitance; an input voltage inversion/output means connected at its input terminal to the other end of the first capacitance; an illuminating means controlled by an output of the input voltage inversion/output means; a second switch means provided between the input terminal and an output terminal of the input voltage inversion/output means, wherein the first switch means, the input voltage inversion/output means, the illuminating means and the second switch means are provided in at least one of the plurality of pixels; a pixel drive voltage generation means for generating a pixel drive voltage, the pixel drive voltage being swept within a predetermined voltage range including the display signal voltage; and a pixel drive voltage input means for inputting the pixel drive voltage to the one end of the first capacitance in the pixel.

The image display described above normally has a display signal processing circuit which stores a display signal taken in from outside and processes data of the display signal.

The problem of this invention can also be solved by an image display which has a display area made up of a plurality of pixels and a signal line for feeding a display signal voltage to the pixels, the image display comprising, in at least one of the plurality of pixels: a memory means for storing the display signal voltage entered from the signal line to the pixel; a pixel turn-on period decision means for determining an ON period and an OFF period for an image output in the pixel according to the display signal voltage; and a pixel drive means for repeating an ON operation of the image output a plurality of times in one frame.

DESCRIPTION OF THE EMBODIMENTS

First Embodiment

A first embodiment of the present invention will be described by referring to FIGS. 1 to 8.

First, an overall configuration of this embodiment will be explained by referring to FIG. 1.

Figure 1:
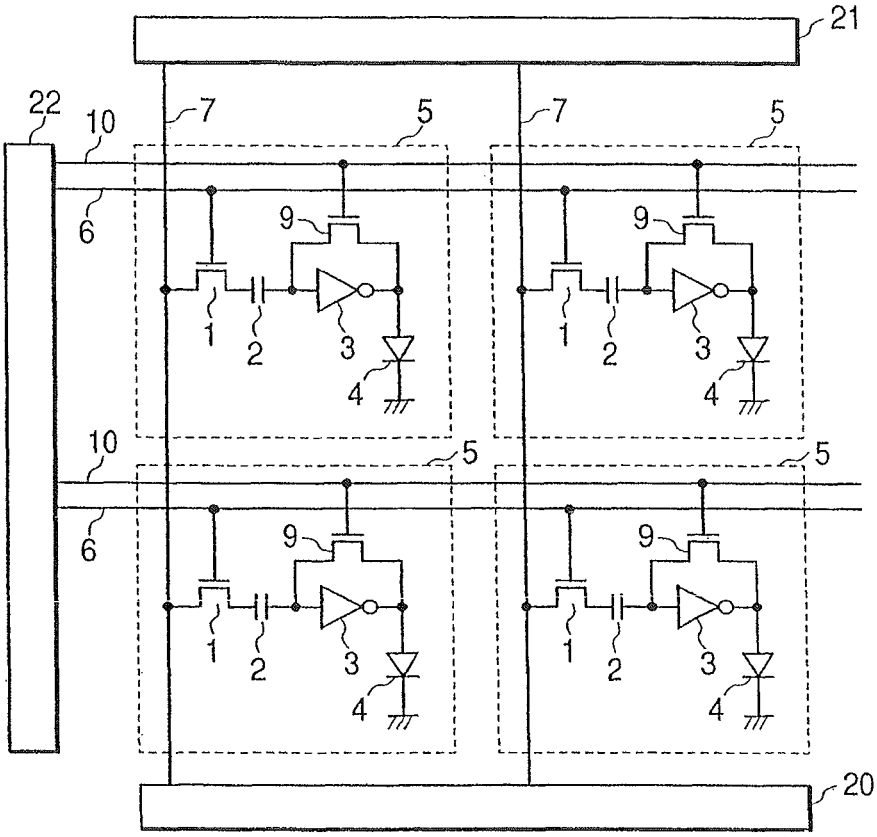
FIG. 1 illustrates a configuration of an OLED display panel as a first embodiment of the present invention.

FIG. 1 shows a configuration of an organic light emitting diode (OLED) display panel of this embodiment. Pixels 5 each having an OLED 4 as a pixel light emitting device are arranged in matrix in a display area. The pixels 5 are connected to predetermined drive circuits through gate lines 6, signal lines 7 and reset lines 10. The gate lines 6 and reset lines 10 are connected to a gate drive circuit 22, and the signal lines are connected to a signal drive circuit 21 and a triangular wave (triangular pattern) input circuit 20. The pixels 5, gate drive circuit 22, signal drive circuit 21 and triangular wave input circuit 20 are all formed from polysilicon TFTs on a glass substrate. In each pixel 5, the signal line 7 is connected through an input TFT 1 to one end of a storage capacitor 2, the other end of which is connected to one end of a reset TFT 9 and an input terminal of an inverter circuit 3. The other end of the reset TFT 9 and an output terminal of the inverter circuit 3 are grounded in common to a common ground terminal through an OLED 4.

Next, the inverter circuit 3 will be explained by referring to FIG. 6.

Figure 6:
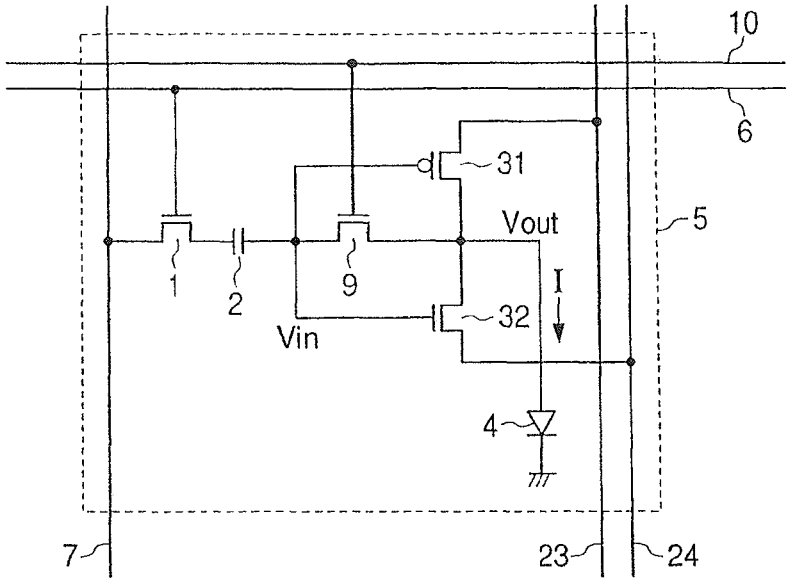
FIG. 6 illustrates a configuration of one pixel in the first embodiment.

FIG. 6 shows a configuration of one pixel in this embodiment. The inverter circuit 3 comprises an n-channel polysilicon TFT 32 and a p-channel polysilicon TFT 31, with their sources connected to an n-channel source line 24 and a p-channel source line 23, respectively. In this embodiment, since vertical wires are formed from a low-resistance metal and horizontal wires from a gate metal, as described later, the source lines 24, 23 are realized with low-resistance vertical wires.

Before proceeding to the explanation of the overall operation of this embodiment, the operation of the inverter circuit 3 shown in FIG. 6 will be described by referring to FIG. 2 to FIG. 4.

Figure 3:
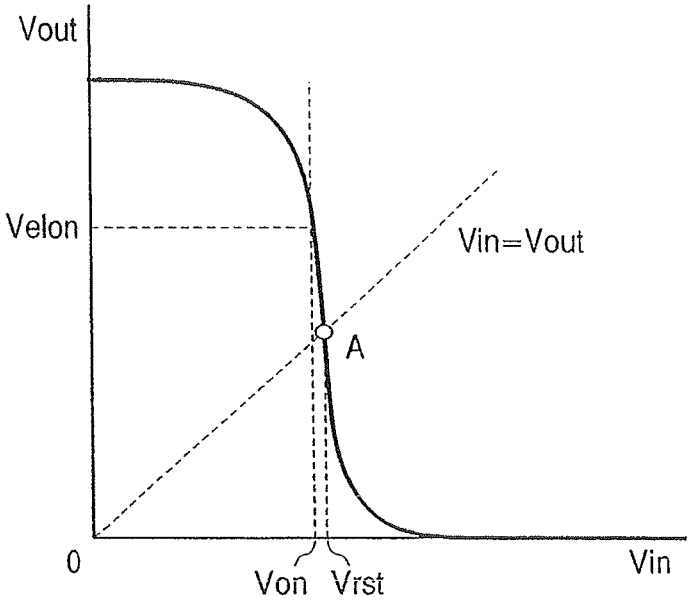
FIG. 3 illustrates an input voltage-output voltage characteristic of an inverter circuit in the first embodiment.

FIG. 3 shows an input voltage-output voltage, Vin-Vout, characteristic of the inverter circuit 3, in which a solid curve represents the voltage characteristic. Suppose the reset TFT 9 is turned on. In this case, Vin and Vout become equal. A white dot "A" in the figure represents an operation point and the input/output voltage is reset to Vrst. As is well known, Vrst at this time represents a logic inversion threshold in the inverter voltage characteristic.

Figure 2:
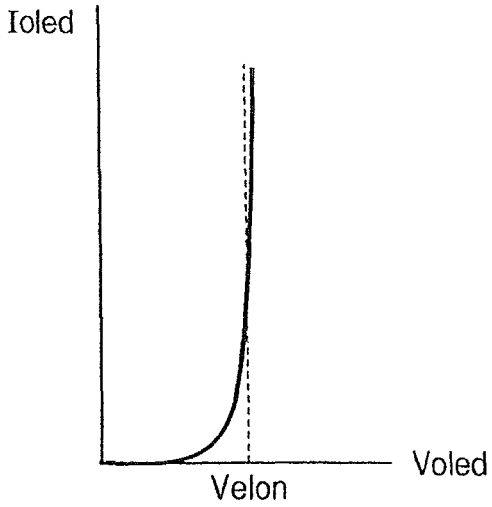
FIG. 2 illustrates a voltage-current characteristic of an OLED in the first embodiment.

Next, an input voltage-output current, Voled-Ioled, characteristic is shown in FIG. 2. Since the OLED is a diode, when a predetermined voltage, Velon, is exceeded, the current sharply rises (the TFT 9 turns on) as shown in the figure. Generally, this OLED current characteristic is reported to be a function of the input voltage raised to sixth or seventh power.

Here, let us consider a case where the characteristic of the inverter circuit 3 of FIG. 3 and the characteristic of the OLED 4 of FIG. 2 are combined. That is, the output voltage, Vout, of the inverter circuit 3 is substituted by the input voltage, Voled, of the OLED 4. Further, as shown in FIG. 3, the voltages of the n-channel source line 24 and the p-channel source line 23 are set so that Velon is higher than "A" and smaller than the output high level of the inverter circuit 3 (the OLED 4 turns on in the output range of the inverter circuit 3). At this time, if the input corresponding to Velon is taken to be Von, it is understood that the current, Ioled, of the OLED 4 will rapidly rise at around the input voltage, Von, of the inverter circuit 3.

Figure 4:
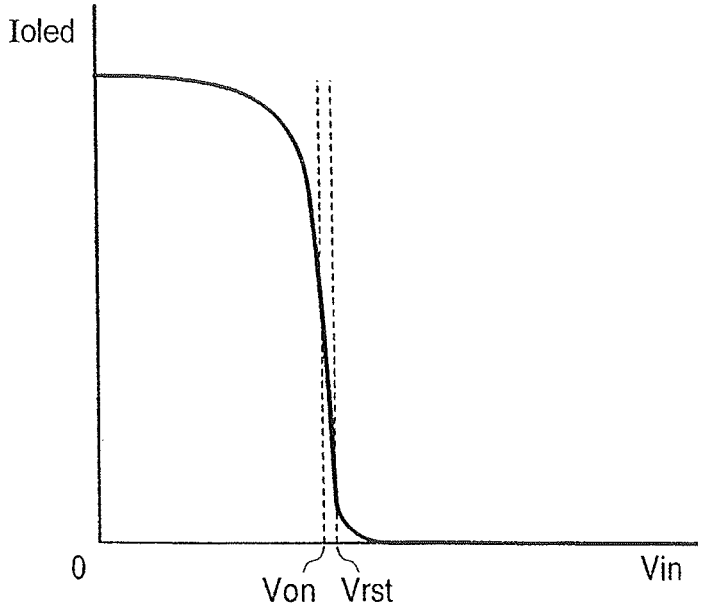
FIG. 4 illustrates an input voltage-current characteristic of an inverter circuit in the first embodiment.

FIG. 4 shows the characteristic of the inverter circuit 3, with the input voltage, Vin, of the inverter circuit 3 taken as abscissa and the current, Ioled, of the OLED 4 as ordinate. Ioled turns on almost in a rectangular fashion at Von, an input voltage which is slightly lower than Vrst. If the rise characteristic of the inverter circuit 3 is sufficiently steep, the values of Vrst and Von are very close to each other and can be regarded approximately as the same voltage.

Next, the overall operation of this embodiment will be described by referring to FIG. 5.

Figure 5:
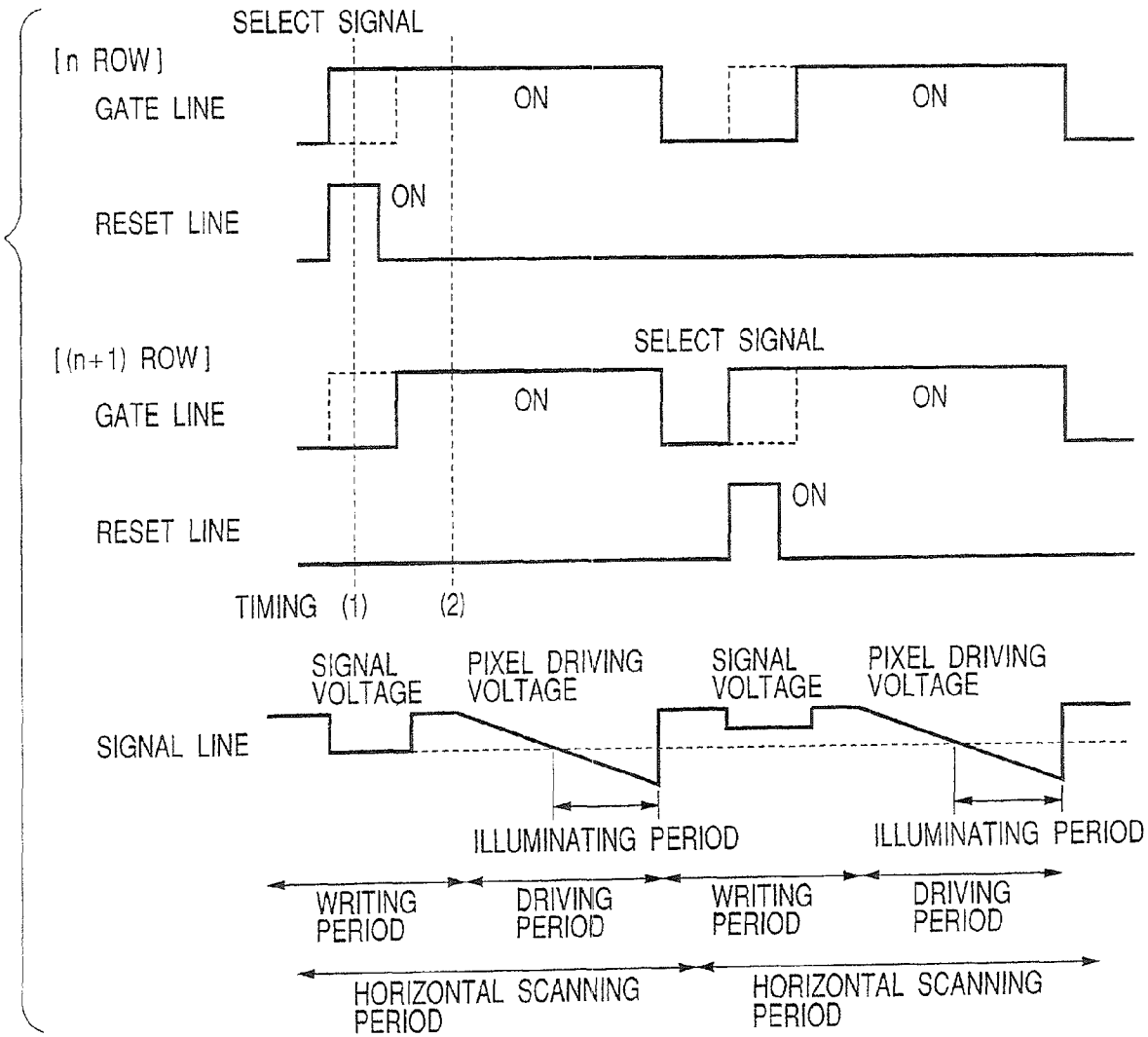
FIG. 5 illustrates operation waveforms of a gate line, a reset line and a signal line in the first embodiment.

FIG. 5 shows, over a writing period for two lines of pixels (two horizontal scanning periods), operation waveforms of a gate line 6 and a reset line 10 on an nth line and an (n+1)st line and an operation waveform of a signal line 7.

The first half of one horizontal scanning period is a "writing period" of a display signal. At timing (1) in the figure, the gate line 6 and the reset line 10 on a selected pixel line (here, nth line) go high. Because in this embodiment the input TFT 1 and the reset TFT 9 are of n-channel, the gate line 6 and the reset line 10 represent an on-state when they are at high level (on high voltage side) and an off-state when they are at low level (on low voltage side). Thus, at this timing, the input TFT 1 and the reset TFT 9 on the selected pixel line are turned on. When the reset TFT 9 turns on, the input/output voltage of the inverter circuit 3 is reset to Vrst, which is applied to one end of the storage capacitor 2, as described in the preceding paragraphs concerning the operation of the inverter circuit 3. At the same time, a predetermined display signal voltage is input to each of the signal lines 7. This display signal voltage is applied to the other end of the storage capacitor 2 through the turned-on input TFT 1. After this, the voltage of the reset line 10 goes low, turning off the reset TFT 9. The above operation writes into each of the storage capacitors 2 on the selected pixel line a signal charge that is required to feed Vrst to the input of the inverter circuit 3 when the above display signal voltage is entered from the signal line 7. If the rise characteristic of the inverter circuit 3 is sufficiently steep, the values of Vrst and Von are very close to each other and can be regarded approximately as the same voltage. That is, when the display signal voltage is applied to the pixel from the signal line 7, the output of the inverter circuit 3 becomes almost Velon, turning the OLED 4 on or off. In FIG. 5, the values of Vrst and Von are shown approximately to be the same voltage for the sake of simplicity.

The second half of one horizontal scanning period is a "driving period" not only for a selected pixel line but also for all the remaining pixels. At timing (2) in FIG. 5, the gate lines 6 for all pixels go high, turning on the input TFTs 1 of all pixels. Also during this period, a triangular pixel drive voltage is applied to each of the signal lines 7 and swept in a range including the display signal voltage level that was already written into the pixels. Because the input TFTs 1 are on, this pixel drive voltage is fed into the storage capacitors 2 of all pixels. At this time, the input voltages of the inverter circuits 3 become Vrst (=Von) in the order in which the display signal voltage already written in the pixel matches the triangular pixel drive voltage, thus turning on the OLEDs 4 of these pixels. In this embodiment, therefore, by modulating the illuminating time of each pixel according to the prewritten display signal voltage, the pixels can be illuminated at multiple illumination levels. At this time, if the lower end of the sweep range of the pixel driving voltage is set at the lowest display signal voltage level, only those pixels into which the lowest display signal voltage level has been written can be made to have a black level where the OLED 4 does not light up at all. In reality, however, since there are influences of noise, it is desired that the lower end of the sweep range of the pixel driving voltage be set slightly higher than the lowest display signal voltage level in order to provide a sufficiently high contrast to the display panel while guaranteeing the black level where the pixel does not light up at all.

In this embodiment, characteristic variations of the n-channel polysilicon TFT 32 and the p-channel polysilicon TFT 31 making up the inverter circuit 3 for driving the OLED 4 cause little luminance non-uniformity and it is possible to avoid pixel-to-pixel display characteristic variations. This is because the input voltage of the inverter circuit 3, Vrst, when the reset TFT 9 is turned on can be regarded approximately equal to Von, regardless of the TFT characteristic variations, as described earlier. A prerequisite for this can be met if the output rise characteristic of the inverter circuit 3 is sufficiently steep. This can be achieved by designing parameters and operating conditions of each pixel in such a way that the transconductance of the n-channel polysilicon TFT 32 and the p-channel polysilicon TFT 31 is sufficiently larger than the drain conductance of each TFT and the input conductance of the OLED 4.

Next, a detailed structure of this embodiment will be described by referring to FIG. 7 and FIG. 8.

Figure 7:
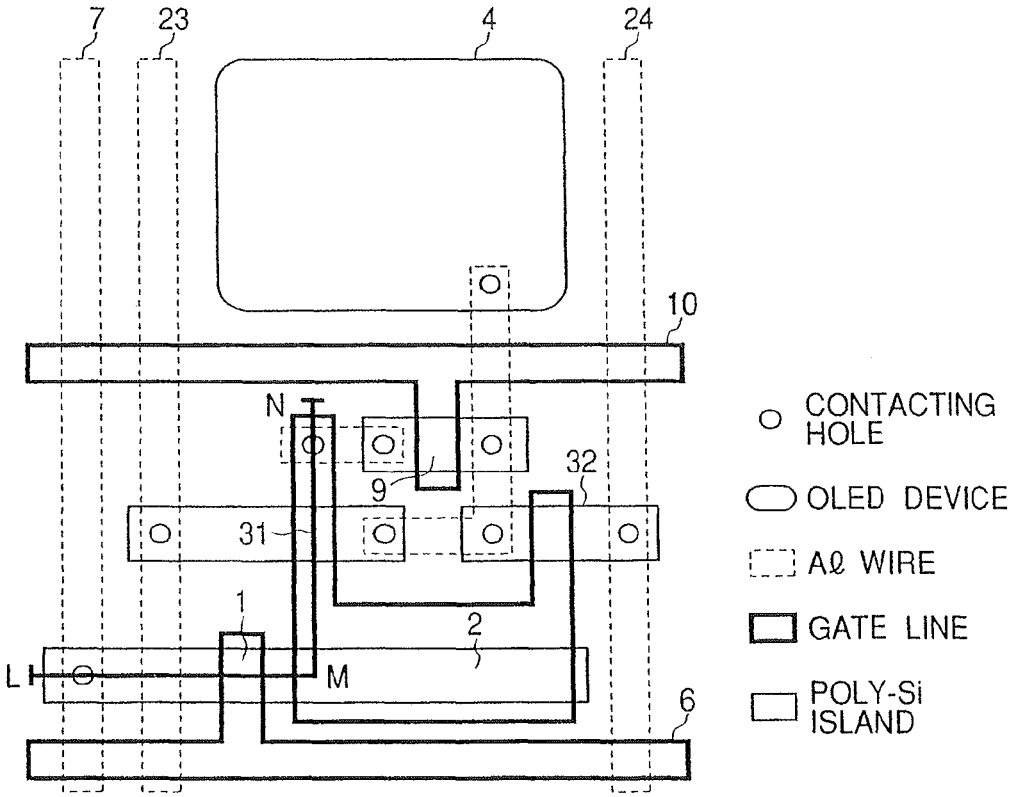
FIG. 7 is a pixel layout in the first embodiment.

FIG. 7 shows a layout of the pixel 5 of this embodiment. In a vertical direction, the signal line 7, the n-channel source line 24 and the p-channel source line 23 are formed from a low-resistance aluminum wire. In a horizontal direction, the gate line 6 and the reset line 10 are formed from a gate wire. At an intersection between the signal line 7 and the gate line 6 the input TFT 1 formed by the low-temperature polysilicon TFT process is provided, with the other end of the input TFT 1 extending laterally to form one of electrodes of the storage capacitor 2. An opposite electrode of the storage capacitor 2 constitutes, as is, gate electrodes of the n-channel low-temperature polysilicon TFT 32 and the p-channel low-temperature polysilicon TFT 31. As already described, the sources of the n-channel low-temperature polysilicon TFT 32 and the p-channel low-temperature polysilicon TFT 31 are connected to the n-channel source line 24 and the p-channel source line 23, respectively. The drains of the n-channel polysilicon TFT 32 and the p-channel polysilicon TFT 31 are connected in common to the input of the OLED 4. At the same time, the drain terminals are also connected to one end of the reset TFT 9 whose gate is formed from the reset line 10. The other end of the reset TFT 9 is connected to the opposite electrode described above. The common ground terminal of the OLED 4 is connected in common with ground terminals of other pixels for grounding. This is not shown in FIG. 7 for simplicity.

Figure 8:
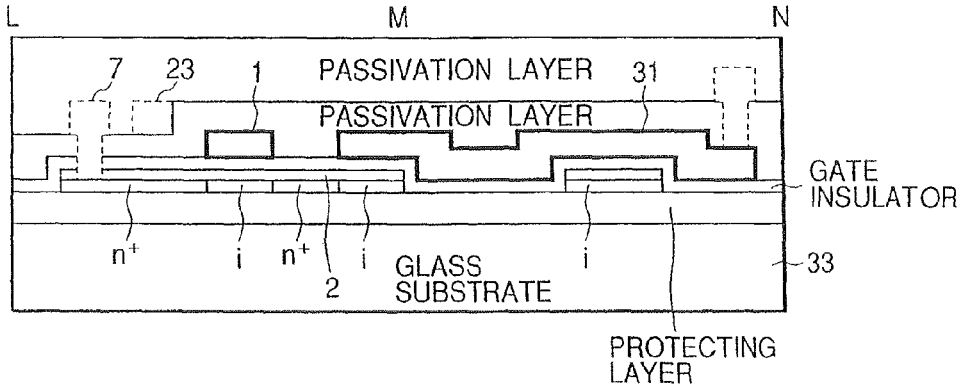
FIG. 8 is a cross section of a pixel in the first embodiment.

FIG. 8 is a cross section taken along the line "L-M-N" of FIG. 7. As already described, polysilicon islands constituting the channels of the input TFT 1 extend horizontally to form the storage capacitor 2 between the gate electrodes of the n-channel polysilicon TFT 32 and the p-channel polysilicon TFT 31. Since the storage capacitor 2 is formed of a gate capacitance of TFT, it is driven under the condition that a voltage equal to or more than Vth is always applied between the electrodes of the gate capacitance, in order to form a channel of the storage capacitor 2. It is important that the storage capacitor 2 be designed in advance to have a large value. This is because the input capacitances of the gate electrodes of the n-channel low-temperature polysilicon TFT 32 and the p-channel low-temperature polysilicon TFT 31 become apparently very large due to the Miller effect. As shown in FIG. 8, the construction described above is formed on a transparent glass substrate 33 so that light from the OLED 4 can be extracted downwardly from the substrate.

The peripheral driving circuits, including the gate drive circuit 22 made up of shift registers and selector switches, the signal drive circuit 21 made up of 6-bit DA conversion circuits, and the triangular wave input circuit 20 for buffering externally input triangular waves (triangular patterns), are also constructed of the low-temperature polysilicon TFT circuits similar to those used in the pixel area shown in FIG. 8. These circuits can be realized by commonly known technologies and thus their explanations are omitted here.

In the embodiment described above, various modifications may be made without departing from the scope of the present invention. For example, although this embodiment uses the glass substrate 33 as the TFT substrate, it may be replaced with other transparent insulating substrates such as a quartz substrate and a transparent plastic substrate. Alternatively, an opaque substrate may be employed if the light from the OLED 4 is extracted upwardly from the upper surface.

Further, although in this embodiment the input TFT 1 and the reset TFT 9 use n-channel TFTs, they may also use p-channel TFTs or CMOS switches if the driving waveforms are changed appropriately. The inverter circuit 3 also is not limited to the CMOS inverter used in this embodiment. Modifications can of course be made which include, for example, changing the n-channel TFT to a current source circuit.

In this embodiment, the cost reduction based on the simplified fabrication process is realized by forming the structure of the storage capacitor 2 in the same process as the TFT gate structure, as described earlier. To obtain the advantages of this invention does not necessarily require the common use of these constitutional elements. It is possible to introduce high concentrations of impurities under the gate of the storage capacitor 2 or to form the structure of the storage capacitor 2 by using a gate layer and a wire layer.

Further, the description of this embodiment does not refer to the number of pixels and panel size because the present invention is not limited by these specifications and formats. While the display signal voltage in this embodiment is a 64-level (6-bit) discrete multilevel illumination voltage, it may use an analog voltage. There is no limitation on the number of levels for the multilevel illumination signal voltage. Further, while the voltage of common terminal for the OLEDs 4 is used as a ground voltage, it is needless to say that this voltage value can be changed under predetermined conditions.

In this embodiment the peripheral driving circuits, including the gate drive circuit 22, the signal drive circuit 21 and the triangular wave input circuit 20, are constructed of low-temperature polysilicon TFT circuits. However, these peripheral driving circuits or a part of them may be constructed of a single crystal LSI (large scale integrated) circuit without departing from the scope of this invention.

In this embodiment, the OLED 4 is used as a light emitting device. It is obvious in realizing the present invention, however, that the OLED 4 can be replaced with other general light emitting devices including inorganic devices.

When a color display is manufactured by preparing three kinds of light emitting devices according to three different colors, red, green and blue, the areas of the light emitting devices and the driving voltage conditions should preferably be changed to achieve a color balance. In changing the driving voltage conditions, adjustments may be made by differentiating the voltages of the n-channel source line 24 and p-channel source line 23 among different colors. In this case, from the viewpoint of simplifying wiring, it is desired that the devices for the three colors be arranged in stripes. As to the common terminal voltage of the OLEDs 4 that is used as the ground voltage in this embodiment, three different common terminals for the OLEDs 4, one for each of the three colors, red, green and blue, may be prepared and driven by appropriate different voltages. Further, appropriately adjusting the driving voltages according to the display conditions and display patterns can realize a color temperature compensation function.

Various modifications described above are applicable not only to this embodiment but also to other embodiments basically in the similar way.

Second Embodiment

A second embodiment of the present invention will be described by referring to FIG. 9.

The configuration and operation of this embodiment are basically similar to those of the first embodiment, except that the operation waveform of the signal line 7 differs from that of the first embodiment shown in FIG. 5. Thus, the descriptions of the configuration and operation of this embodiment are omitted here and only the operation waveform of the signal line 7, which is the feature of this embodiment, will be explained.

Figure 9:
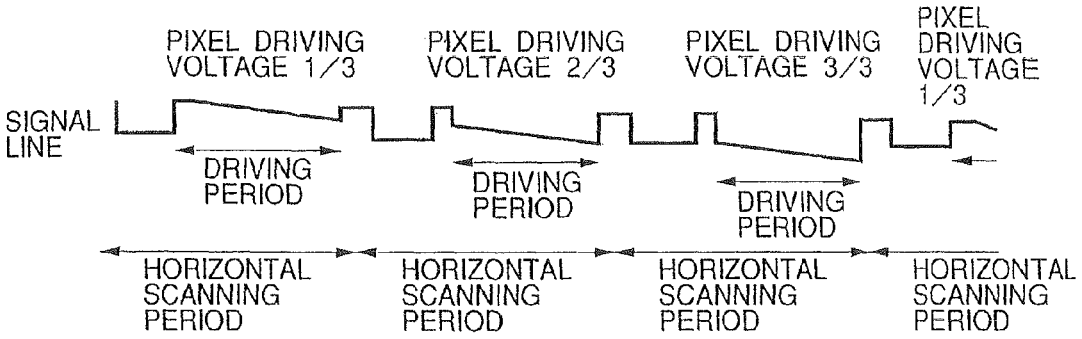
FIG. 9 illustrates an operation waveform of a signal line in a second embodiment of the present invention.

FIG. 9 shows the operation waveform of the signal line 7 in the second embodiment. In the first embodiment, during the driving periods the same pixel driving voltage sweep waveform is repeated for each horizontal scanning period. In the second embodiment, however, the pixel driving voltage sweep waveform is divided into three parts and three horizontal scanning periods combine to form one cycle of the triangular wave (triangular pattern).

This arrangement in the second embodiment reduces the driving frequency of the triangular wave and thus allows an output impedance of the triangular wave input circuit 20 to be designed at an increased value, thus reducing the driving power consumption.

Although in this embodiment the sweep frequency of the triangular wave is set to three times the horizontal scanning period, it is generally possible to set the sweep frequency to an arbitrary n times the horizontal scanning period. For example, the sweep frequency may be set to a frame frequency that corresponds to the rewriting period of all pixels or to an arbitrary m times the frame frequency. It is also possible to change the sweep frequency of the triangular wave according to the content of a display image (e.g., whether it is a static image or a moving image) or to its use. Care should taken not to set the sweep frequency of the triangular wave too slow or not equal to a natural number times the horizontal scanning period because such settings will cause visually perceivable flickers.

When the sweep frequency of the triangular wave is set lower than the frame frequency, pseudo-profiling noise similar to the one observed in plasma display panels (PDPs) may occur. It is therefore desired that the sweep frequency of the triangular wave be set higher than the frame frequency or, more preferably, two times the frame frequency.

Third Embodiment

Now, a third embodiment of the present invention will be described by referring to FIG. 10.

The configuration and operation of this embodiment are basically similar to those of the first embodiment, except that the operation waveform of the signal line 7 differs from that of the first embodiment shown in FIG. 5. Thus, the descriptions of the configuration and operation of this embodiment are omitted here and only the operation waveform of the signal line 7, which is the feature of this embodiment, will be explained.

Figure 10:
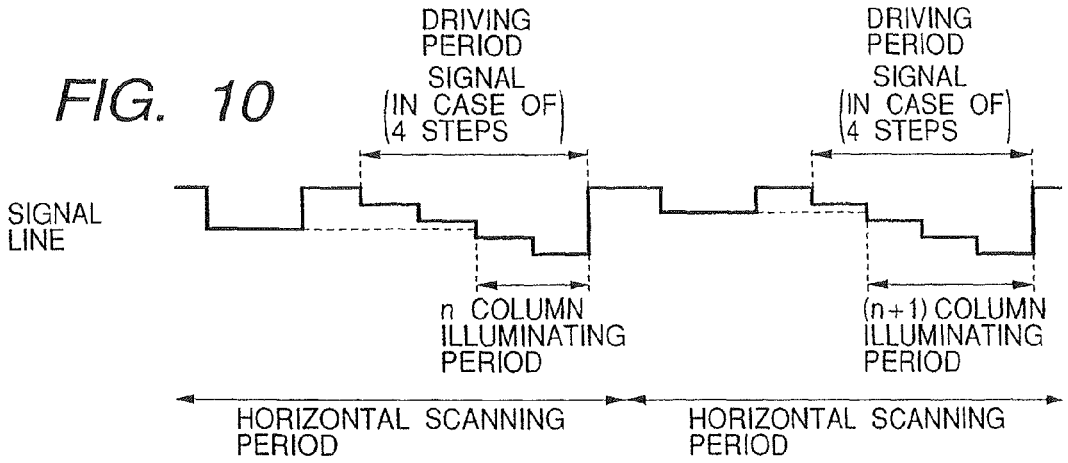
FIG. 10 is an operation waveform of a signal line in a third embodiment of the present invention.

FIG. 10 shows the operation waveform of the signal line 7 in the third embodiment. In the first embodiment, the pixel driving voltage sweep waveform during the driving period is a continuously changing triangular wave. In the third embodiment, the writing signal is a 4-level (2-bit) illumination signal and the pixel driving voltage sweep waveform is also a 4-level stepped waveform. It should be noted here that each of the four voltage levels of the 4-level writing signal is set at a median value between each stepped voltage level of the pixel driving voltage sweep waveform.

With this arrangement in the third embodiment, subtle changes in the signal line voltage caused by noise are almost prevented from being reflected on the illumination of the OLEDs 4, thus producing an image with a good S/N ratio. The reason that the signal line voltage changes are hardly reflected on the OLED illumination is that, because each of the four voltage levels of the 4-level writing signal is set at a median value between each stepped voltage level of the pixel driving voltage sweep waveform, there is no possibility that noise with a magnitude less than half each stepped voltage level will shift the associated voltage level.

While in this embodiment the writing signal and the pixel driving voltage sweep waveform are of 4-level (2-bit) waveforms, it is obvious that the present invention does not place any limitation on the number of levels for the multilevel illumination. For example, it is possible to use 64 levels (6 bits) or any other number of levels for multilevel illumination. But from the above discussion of the S/N ratio, caution should be exercised because the smaller the voltage difference between each multilevel illumination level, the more susceptible the waveform will be to noise.

In the preceding embodiments including the third embodiment, the pixel driving voltage sweep waveform is basically linear. From the viewpoint of the S/N ratio or $\gamma$ characteristic, it is possible to sweep a nonlinear pixel drive voltage, as required.

Fourth Embodiment

A fourth embodiment of the present invention will be described by referring to FIG. 11.

The configuration and operation of this embodiment are basically similar to those of the first embodiment, except that the pixel structure differs from that of the first embodiment shown in FIG. 6. Thus, the descriptions of the overall configuration and operation of this embodiment are omitted here and only the pixel structure, which is the feature of this embodiment, will be explained.

Figure 11:
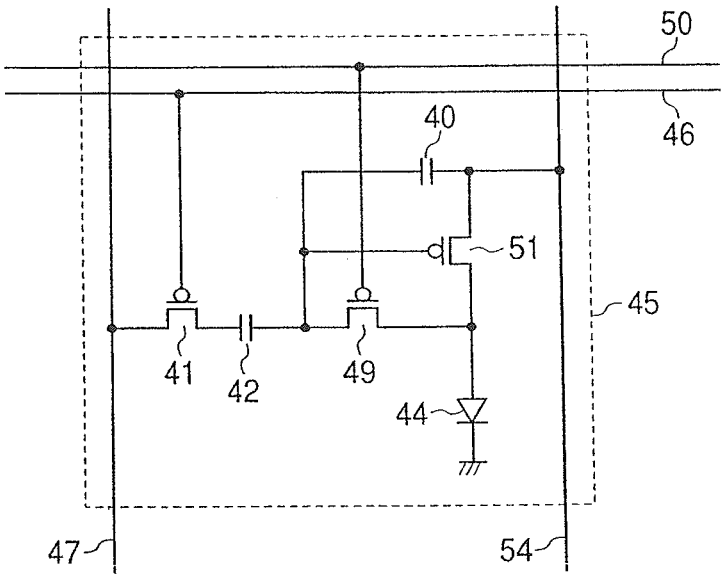
FIG. 11 illustrates a configuration of one pixel in a fourth embodiment.

FIG. 11 shows the configuration of one pixel in the fourth embodiment.

A pixel 45 having an OLED 44 as a pixel light emitting device is connected to peripheral driving circuits via a gate line 46, a signal line 47, a reset line 50 and a p-channel source line 54. The signal line 47 is connected to one end of a storage capacitor 42 through an input TFT 41 controlled by the gate line 46. The other end of the storage capacitor 42 is connected to one end of a reset TFT 49 controlled by the reset line 50 and to a gate terminal of a p-channel polysilicon TFT 51. The other end of the reset TFT 49 and one end of the p-channel polysilicon TFT 51 are grounded in common to a common ground terminal through the OLED 44. The gate of the p-channel polysilicon TFT 51 is connected to the source of the p-channel polysilicon TFT 51 through an auxiliary capacitance 40, and the source of the p-channel polysilicon TFT 51 is connected to a p-channel source line 54. In this embodiment, too, the vertical wires are formed from a low-resistance metal and the horizontal wires from a gate metal, so that the signal line 47 and the p-channel source line 54 are realized with the low-resistance vertical wires. In the fourth embodiment, the inverter circuit 3 of the first embodiment can be regarded as being equivalently formed from the p-channel polysilicon TFT 51 with the OLED 44 as a load. The auxiliary capacitance 40 is added in order to stabilize the input capacitance value of the inverter circuit constructed of the p-channel polysilicon TFT 51 with the OLED 44 as a load. If the rise characteristic of the equivalent inverter circuit is stable, the auxiliary capacitance 40 may be omitted.

The operation of the pixel in the fourth embodiment is basically similar to that of the first embodiment. It should be noted, however, that, because in this embodiment the input TFT 41 and the reset TFT 49 are formed not from n-channel TFTs but from p-channel low-temperature polysilicon TFTs, the gate line 46 and the reset line 50 have their drive waveforms inverted from those of the first embodiment.

In this embodiment, the number of TFTs making up the pixel 45 is reduced, making it possible to provide a display panel at a lower cost with an improved yield. Further, because the pixel has no n-channel polysilicon TFT, if the peripheral circuits are formed from external LSI or from only p-channel circuits without using n-channel polysilicon TFTs, it is possible to manufacture a display panel without forming n-channel polysilicon TFTs. In this case, the n-channel forming process is obviated, which in turn leads to a further cost reduction in realizing a display panel.

Fifth Embodiment

A fifth embodiment of the present invention will be described by referring to FIG. 12.

The configuration and operation of this embodiment are basically the same as those of the first embodiment, except that the pixel structure differs from that of the first embodiment shown in FIG. 6. Thus, in this embodiment too, the descriptions of its overall configuration and operation are omitted here and the pixel structure, which is the feature of this embodiment, will be explained.

Figure 12:
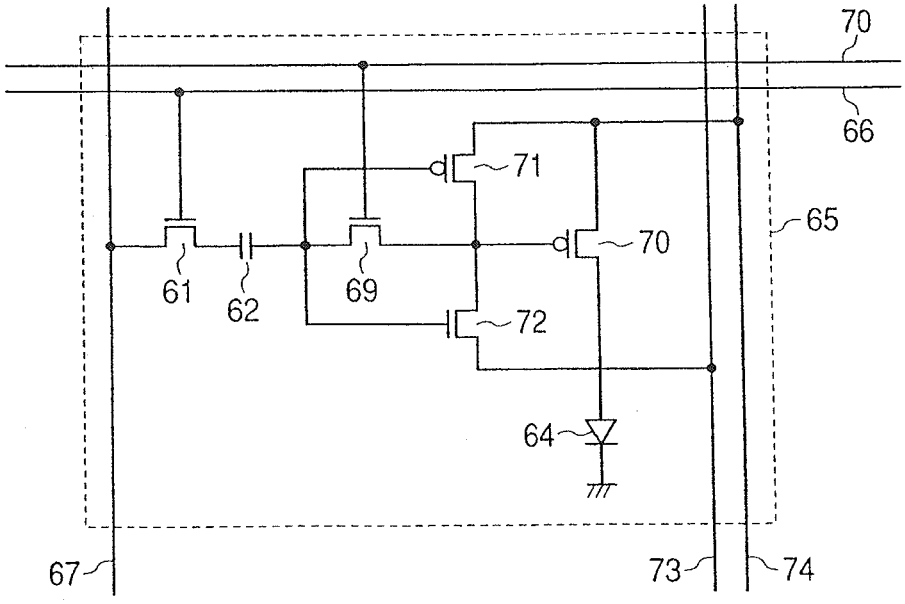
FIG. 12 illustrates a configuration of one pixel in a fifth embodiment.

FIG. 12 shows the configuration of one pixel in the fifth embodiment.

A pixel 65 having an OLED 64 as a pixel light emitting device is connected to peripheral driving circuits via a gate line 66, a signal line 67, a reset line 70, an n-channel source line 73 and a p-channel source line 74. The signal line 67 is connected to one end of a storage capacitor 62 through an input TFT 61 controlled by the gate line 66. The other end of the storage capacitor 62 is connected to one end of a reset TFT 69 controlled by the reset line 70 and to gate terminals of a p-channel polysilicon TFT 71 and an n-channel polysilicon TFT 72. The other end of the reset TFT 69 and drains of the p-channel polysilicon TFT 71 and n-channel polysilicon TFT 72 are connected in common to a gate of an OLED-driving TFT 70, with the drain of the OLED-driving TFT 70 grounded to a common ground terminal through the OLED 64. Sources of the p-channel polysilicon TFT 71 and OLED-driving TFT 70 are connected in common to a p-channel source line 74. A source of the n-channel polysilicon TFT 72 is connected to an n-channel source line 73. In this embodiment too, vertical wires are formed from a low-resistance metal and horizontal wires from a gate metal. Thus, the signal line 67, the n-channel source line 73 and the p-channel source line 74 are realized with low-resistance vertical wires. In the fifth embodiment, the inverter circuit 3 of the first embodiment can be regarded as equivalently having the OLED-driving TFT 70 as a buffer.

The operation of the pixel in the fifth embodiment is basically similar to that of the first embodiment and its explanation is omitted here.

In this embodiment, the inverter circuit made up of the p-channel polysilicon TFT 71 and the n-channel polysilicon TFT 72 is isolated from the OLED 64 by the OLED-driving TFT 70 as a buffer and thus is driven irrespective of the characteristic of the OLED 64. Therefore, the operation stability of the inverter circuit is enhanced to realize a good rise characteristic of the circuit, further reducing variations in pixel-to-pixel illumination characteristics.

Sixth Embodiment

A sixth embodiment of the present invention will be described by referring to FIG. 13 and FIG. 14.

The configuration and operation of this embodiment are basically the same as those of the first embodiment, except that the pixel structure differs from that of the first embodiment shown in FIG. 6. Thus, in this embodiment too, the descriptions of its overall configuration and operation are omitted here and the pixel structure, which is the feature of this embodiment, will be explained.

Figure 13:
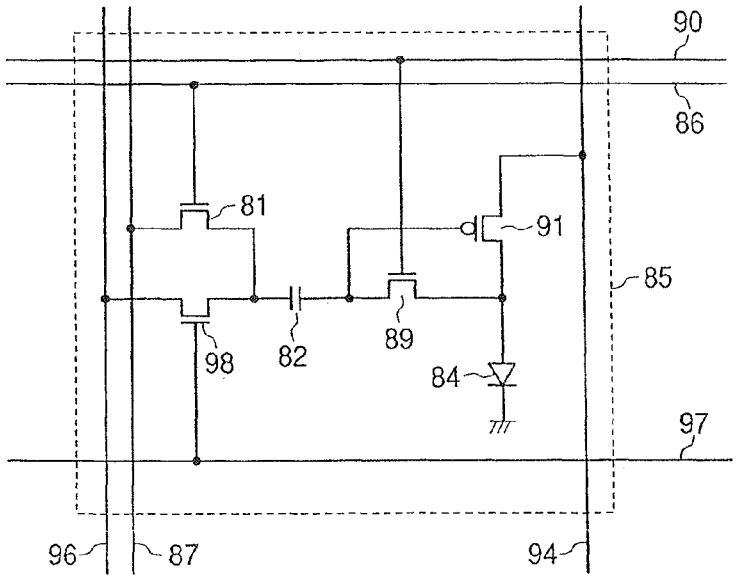
FIG. 13 illustrates a configuration of one pixel in a sixth embodiment.

FIG. 13 shows the configuration of one pixel in the sixth embodiment.

A pixel 85 having an OLED 84 as a pixel light emitting device is connected to peripheral driving circuits via a gate line 86, a signal line 87, a reset line 90, a p-channel source line 94, a drive signal line 96 and a drive gate line 97. The signal line 87 extending from the signal drive circuit 21 (not shown) is connected to one end of a storage capacitor 82 through an input TFT 81 controlled by the gate line 86. The drive signal line 96 extending from the triangular wave input circuit 20 (not shown) is also connected to the one end of the storage capacitor 82 through a drive input TFT 98 controlled by the drive gate line 97. The other end of the storage capacitor 82 is connected to one end of a reset TFT 89 controlled by the reset line 90 and to a gate terminal of a p-channel polysilicon TFT 91. The other end of the reset TFT 89 and one end of the p-channel polysilicon TFT 91 are grounded in common to a common ground terminal through the OLED 84. A source of the p-channel polysilicon TFT 91 is connected to the p-channel source line 94. In this embodiment too, vertical wires are formed from a low-resistance metal and horizontal wires from a gate metal. Hence, the signal line 87, the drive signal line 96 and the p-channel source line 94 are realized with low-resistance vertical wires. The sixth embodiment is similar to the fourth embodiment in that the inverter circuit 3 of the first embodiment equivalently comprises the p-channel polysilicon TFT 91 with the OLED 84 as a load.

The operation of the pixel of the sixth embodiment is basically similar to that of the first embodiment. In this embodiment, however, the storage capacitor 82 has two input routes, one passing through the signal line 87 and the other passing through the drive signal line 96. This is detailed by referring to FIG. 14.

Figure 14:
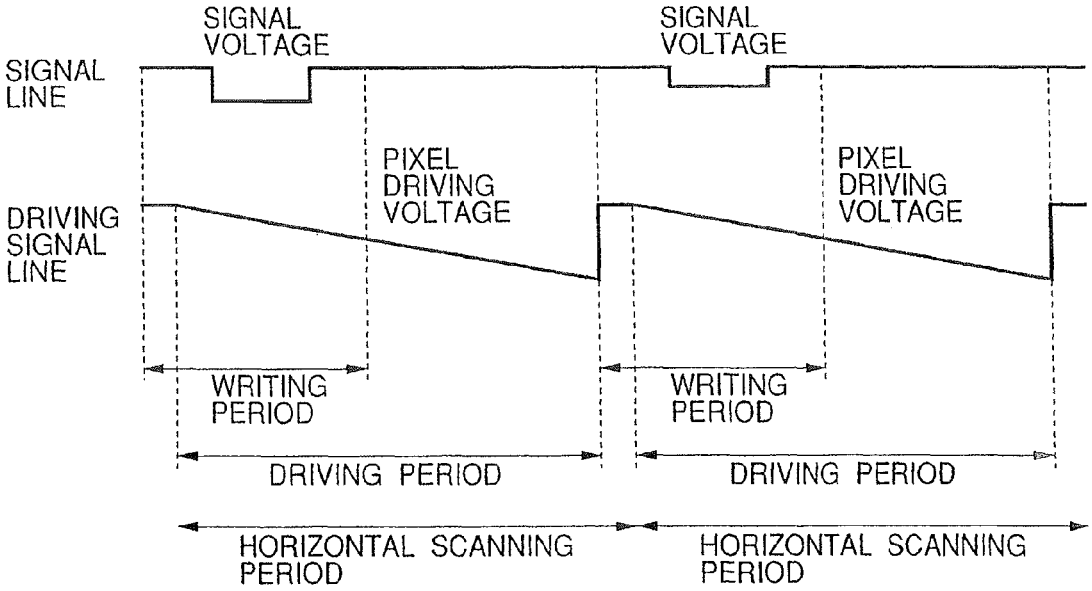
FIG. 14 illustrates drive waveforms of a signal line and a drive signal line in the sixth embodiment.

FIG. 14 shows driving waveforms of the signal line 87 and the drive signal line 96. On a selected line of pixels, the gate line 86 selected during the "writing period" is turned on to write a display signal voltage into the pixel via the signal line 87 and the input TFT 81. On other pixel lines not selected, all the drive gate lines 97 are turned on to feed a pixel drive voltage of triangular waveform to the pixels through the drive signal lines 96 and the drive input TFTs 98, causing the OLEDs 84 to illuminate according to the display signal already written into each pixel.

In this embodiment, either the display signal voltage or the pixel drive voltage is input to each pixel through one of the separate lines—the signal line 87 and the drive signal line 96. Therefore, the pixels that are not selected for writing can be driven for illumination even while the display signal voltage is written into the selected pixels, thus improving the luminance under the same current driving condition. On the selected pixel line, the "writing period" can be extended for up to one horizontal scanning period. Hence, the writing time constant can be expanded, thus reducing power consumption when writing the display signal voltage.

Seventh Embodiment

A seventh embodiment of the present invention will be described by referring to FIG. 15.

Figure 15:
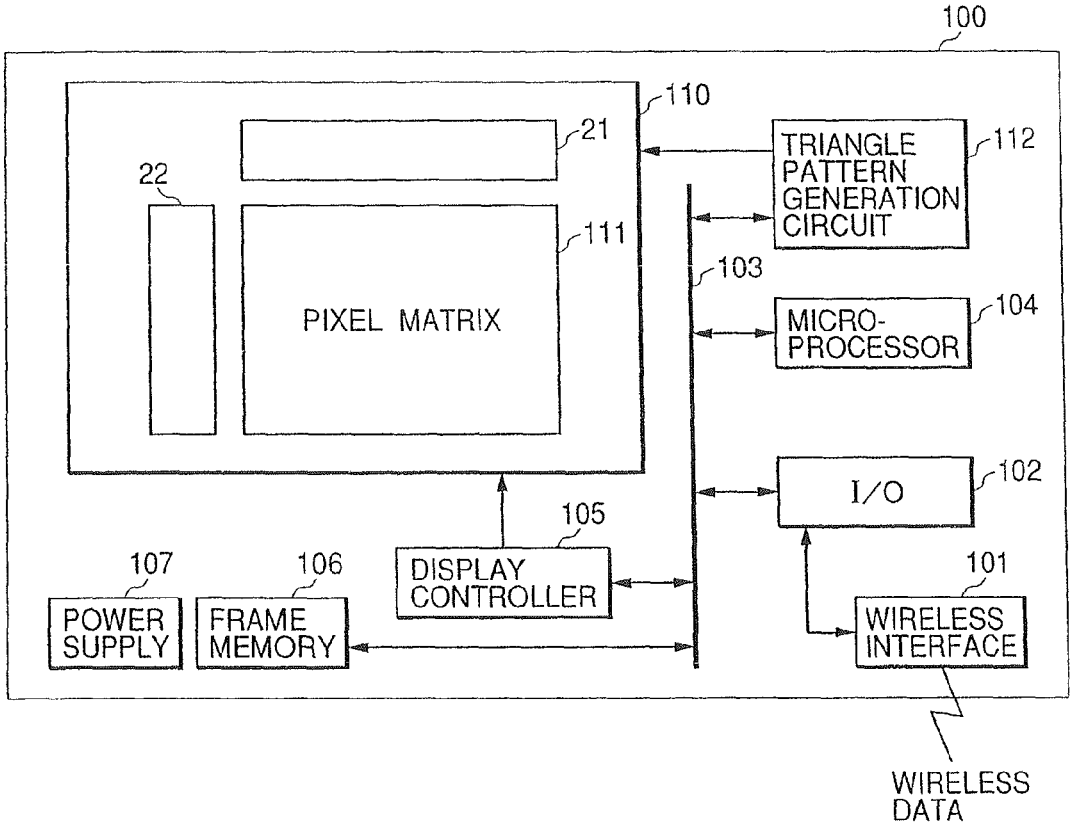
FIG. 15 illustrates a configuration of an image display terminal or personal digital assistant (PDA) in a seventh embodiment.
Figure 16:
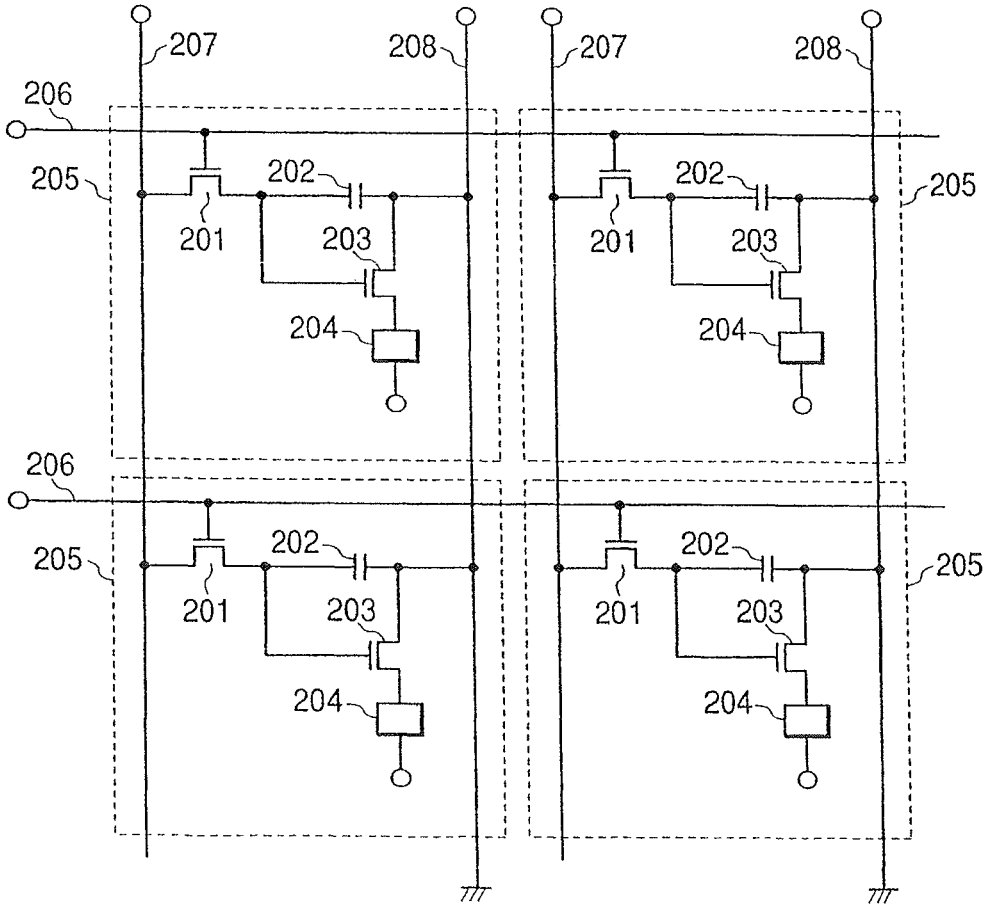
FIG. 16 (PRIOR ART)
FIG. 16 illustrates a configuration of a light emitting display device using a first conventional technology.
Figure 17:
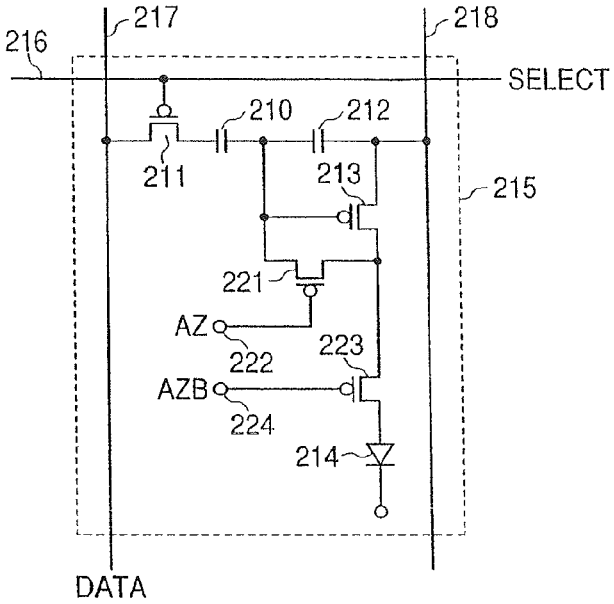
FIG. 17 (PRIOR ART)
FIG. 17 illustrates a configuration of a light emitting display device using a second conventional technology.
Figure 18:
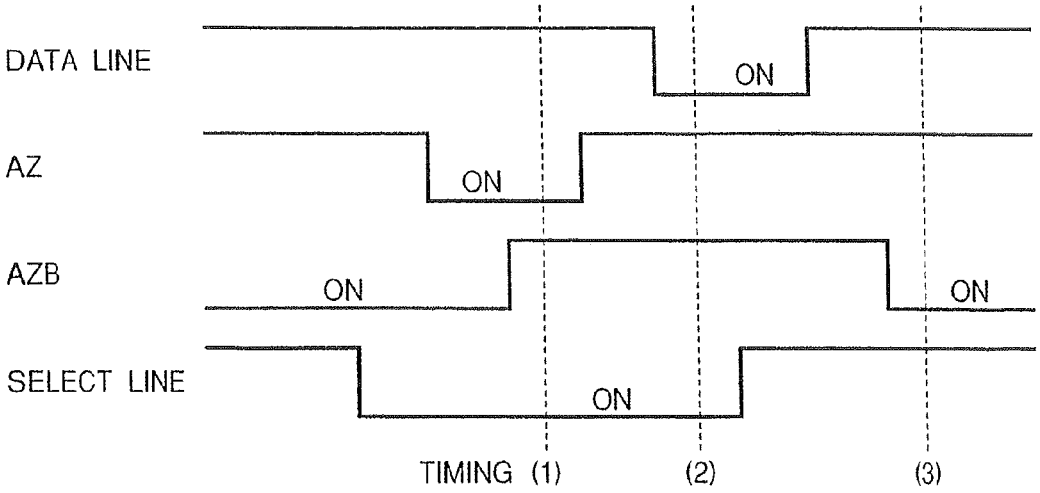
FIG. 18 (PRIOR ART)
FIG. 18 illustrates how a light emitting display device using the second conventional technology operates.

FIG. 15 shows a configuration of an image display terminal or personal digital assistant (PDA) as the seventh embodiment.

To a wireless interface (I/F) circuit 101 is input compressed image data or the like as wireless data based on Bluetooth specifications. An output of the wireless I/F circuit 101 is connected to a data bus 103 through an input/output (I/O) circuit 102. The data bus 103 is also connected with a microprocessor 104, a display panel controller 105, a frame memory 106 and others. An output of the display panel controller 105 is input to an OLED display panel 110, which has a pixel matrix 111, a gate drive circuit 22 and a signal drive circuit 21. The PDA 100 is also provided with a triangular wave generation circuit 112 and a power supply 107. An output of the triangular wave generation circuit 112 is input to the OLED display panel 110. The OLED display panel 110 has the same configuration and operation as those of the first embodiment except that it does not include the triangular wave input circuit 20. Thus the descriptions of inner configuration and operation of the OLED display panel 110 are omitted here.

The operation of the seventh embodiment will be explained. First, the wireless I/F circuit 101 takes in compressed image data from outside according to an instruction, and then transfers the image data to the microprocessor 104 and the frame memory 106 through the I/O circuit 102. According to an instruction from the user, the microprocessor 104 drives the PDA 100 as required to decode the compressed image data, perform signal processing and display information. The image data that has undergone signal processing is stored temporarily in the frame memory 106.

If the microprocessor 104 issues a display instruction, the image data is transferred from the frame memory 106 through the display panel controller 105 to the OLED display panel 110, in which the pixel matrix 111 displays the received image data in real time. At the same time, the display panel controller 105 outputs a predetermined timing pulse required to display an image. In synchronism with the timing pulse, the triangular wave (triangular pattern) generation circuit 112 outputs a triangular pixel drive voltage. The operation in which the OLED display panel 110 displays the display data generated from the 6-bit image data on the pixel matrix 111 in real time by using these signals is already described in the first embodiment. The power supply 107 includes a secondary battery which powers the entire PDA 100.

This embodiment can provide a PDA 100 capable of multi-level illumination which has a minimal pixel-to-pixel display characteristic variation.

While this embodiment has used, as an image display device, a panel similar to the OLED display panel described in the first embodiment, it is obvious that a variety of display panels, such as those used in other embodiments of this invention, can also be used.

With this invention, it is possible to provide an image display which can display an image in multiple illumination levels and has a minimal pixel-to-pixel display characteristic variation.

It will be further understood by those skilled in the art that the foregoing description has been made on embodiments of the invention and that various changes and modifications may be made in the invention without departing from the spirit of the invention and scope of the appended claims.

What is claimed is:

1. An image display device including a plurality of pixels arranged in a matrix form, a pixel drive voltage generating circuit for generating a pixel drive voltage and an image signal voltage generating circuit for generating an image signal voltage, the image display device comprising:

a light emitting element drive circuit for controlling drive current to be provided to a light emitting element formed in each of the plurality of pixels;

a first switching element for switching ON/OFF an input and output of the light emitting element drive circuit, a first terminal of the first switching element being directly connected to an input terminal of the light emitting element;

a capacitor element, a first terminal of which is arranged to be directly connected to a second terminal of the first switching element; and a second switching element, a first terminal of which is arranged to be directly connected to a second terminal of the capacitor element, wherein:

either one of the image signal voltage supplied from the image signal voltage generating circuit or pixel drive voltage supplied from the pixel drive voltage generating circuit is inputted to a second terminal of the second switching element, and wherein:

an amount of the drive current is controlled in accordance with both the pixel drive voltage and the image signal voltage, a gate electrode of the first switching element is directly and electrically connected to a reset line, and a gate electrode of the second switching element is directly and electrically connected to a gate line.

2. The image display device according to claim 1, wherein an output terminal of the image signal voltage generating circuit is connected to a signal line, and wherein the second switching element is provided between the signal line and the capacitor element.

3. The image display device according to claim 1, wherein an output terminal of the pixel drive voltage generating circuit is connected to a drive voltage line, and wherein a third switching element is provided between the drive voltage line and the capacitor element for each of the plurality of pixels.

4. The image display device according to claim 1, wherein the light emitting element drive circuit comprises a thin-film transistor, a source terminal which is arranged to be connected to a power supply line, a gate terminal which is arranged to be operable as a signal input terminal and a drain terminal which is arranged to be operable as a signal output terminal.

5. The image display device according to claim 4, wherein the thin-film transistor comprises a P-channel type transistor.

6. The image display device according to claim 1, wherein the amount of the drive current is controlled in accordance with a difference between an amount of the pixel drive voltage and an amount of the image signal voltage.

7. The image display device according to claim 1, further comprising an inverter connected in parallel with the first switching element between the first terminal of the capacitor element and the input terminal of the light emitting element, wherein the inverter is configured so that the inverter will be reset when a reset signal is provided on the reset line to turn on the first switching element.

8. The image display device according to claim 2, wherein the image signal voltage supplied from the image signal voltage generating circuit and the pixel drive voltages supplied from the pixel drive voltage generating circuit are alternately inputted to the second terminal of the second switching element via the signal line.

9. An image display device including a plurality of pixels arranged in a matrix form, a pixel drive voltage generating circuit for generating a pixel drive voltage and an image signal voltage generating circuit for generating an image signal voltage, the image display device comprising:

a light emitting element drive circuit for controlling drive current to be provided to a light emitting element formed in each of the plurality of pixels;

a first switching element for switching ON/OFF an input and output of the light emitting element drive circuit;

a second switching element which is provided between the light emitting element and the first switching element, a first terminal of which is arranged to be directly connected to an input terminal of the light emitting element, a gate terminal of which is arranged to be directly connected to a first terminal of the first switching element;

a capacitor element, a first terminal of which is arranged to be directly connected to a second terminal of the first switching element; and a third switching element, a first terminal of which is arranged to be directly connected to a second terminal of the capacitor element, wherein:

either one of the image signal voltage supplied from the image signal voltage generating circuit or pixel drive voltage supplied from the pixel drive voltage generating circuit is inputted to a second terminal of the third switching element, and wherein:

an amount of the drive current is controlled in accordance with both the pixel drive voltage and the image signal voltage, a gate electrode of the first switching element is directly and electrically connected to a reset line, a gate electrode of the third switching element is directly and electrically connected to a gate line, and the first switching element and the third switching element comprise N-channel type transistors, and the second switching element comprises a P-channel type transistor.

10. An image display device including a plurality of pixels arranged in a matrix form, a pixel drive voltage generating circuit for generating a pixel drive voltage and an image signal voltage generating circuit for generating an image signal voltage, the image display device comprising:

a light emitting element drive circuit for controlling drive current to be provided to a light emitting element formed in each of the plurality of pixels;

a first switching element for switching ON/OFF an input and output of the light emitting element drive circuit, a first terminal of the first switching element being directly connected to an input terminal of the light emitting element;

a capacitor element, a first terminal of which is arranged to be directly connected to a second terminal of the first switching element; and either one of the image signal voltage supplied from the image signal voltage generating circuit or pixel drive voltage supplied from the pixel drive voltage generating circuit is inputted to a second terminal of the capacitor element, and wherein:

an amount of the drive current is controlled in accordance with both the pixel drive voltage and the image signal voltage, and a gate electrode of the first switching element is directly and electrically connected to a reset line.

11. The image display device according to claim 10, wherein an output terminal of the image signal voltage generating circuit is connected to a signal line, and wherein the second switching element is provided between the signal line and the capacitor element.

12. The image display device according to claim 10, wherein an output terminal of the pixel drive voltage generating circuit is connected to a drive voltage line, and wherein a third switching element is provided between the drive voltage line and the capacitor element for each of the plurality of pixels.

13. The image display device according to claim 10, wherein the light emitting element drive circuit comprises a thin-film transistor, a source terminal which is arranged to be connected to a power supply line, a gate terminal which is arranged to be operable as a signal input terminal and a drain terminal which is arranged to be operable as a signal output terminal.

14. The image display device according to claim 13, wherein the thin-film transistor comprises a P-channel type transistor.

15. The image display device according to claim 10, wherein the amount of the drive current is controlled in accordance with a difference between an amount of the pixel drive voltage and an amount of the image signal voltage.

16. The image display device according to claim 10, further comprising an inverter connected in parallel with the first switching element between the first terminal of the capacitor element and the input terminal of the light emitting element, wherein the inverter is configured so that the inverter will be reset when a reset signal is provided on the reset line to turn on the first switching element.

* * * * *